US010982410B2

(12) United States Patent
Voelz

(10) Patent No.: US 10,982,410 B2
(45) Date of Patent: Apr. 20, 2021

(54) SYSTEM AND METHOD FOR SEMI-AUTONOMOUS CONTROL OF AN INDUSTRIAL MACHINE

(71) Applicant: JOY GLOBAL SURFACE MINING INC, Milwaukee, WI (US)

(72) Inventor: Nicholas R. Voelz, West Allis, WI (US)

(73) Assignee: JOY GLOBAL SURFACE MINING INC, Milwaukee, WI (US)

( * ) Notice: Subject to any disclaimer, the term of this patent is extended or adjusted under 35 U.S.C. 154(b) by 160 days.

(21) Appl. No.: 15/699,434

(22) Filed: Sep. 8, 2017

(65) Prior Publication Data

US 2018/0066414 A1 Mar. 8, 2018

Related U.S. Application Data

(60) Provisional application No. 62/384,880, filed on Sep. 8, 2016.

(51) Int. Cl.
*E02F 9/20* (2006.01)
*E02F 3/43* (2006.01)
(Continued)

(52) U.S. Cl.
CPC ..... *E02F 9/2041* (2013.01); *E02F 3/308* (2013.01); *E02F 3/439* (2013.01); *E21C 27/30* (2013.01); *E21C 47/00* (2013.01)

(58) Field of Classification Search
CPC . E02F 3/437; E02F 3/438; E02F 3/439; E02F 9/2041; E02F 3/48; E02F 9/2004;
(Continued)

(56) References Cited

U.S. PATENT DOCUMENTS 3,642,159 A 2/1972 Askins
3,705,482 A * 12/1972 Purrer ..... A01D 43/082 56/13.9
(Continued)

FOREIGN PATENT DOCUMENTS

DE 19730233 1/1999
DE 19856610 6/1999
(Continued)

OTHER PUBLICATIONS

Winstanley, Graeme J., "Dragline swing automation (1997)", Proceedings of the 1997 IEEE International Conference on Robotics and Automation, Albuquerque, New Mexico—Apr. 1997, pp. 1827 to 1832 (Year: 1997).*
(Continued)

*Primary Examiner* — Rachid Bendidi
*Assistant Examiner* — David A Testardi
(74) *Attorney, Agent, or Firm* — Michael Best & Friedrich LLP

(57) ABSTRACT

A method of operating an industrial machine. The method including controlling, via a controller, a movable component of the industrial machine based on a first signal received from an operator control and controlling, via the controller, the movable component of the industrial machine according to an autonomous operation in response to a second signal. The method further including adjusting the autonomous operation to generate an adjusted autonomous operation in response to receiving a third signal from the operator control and controlling, via the controller, the movable component of the industrial machine according to the adjusted autonomous operation in response to receiving a fourth signal.

24 Claims, 8 Drawing Sheets

(51) Int. Cl.
*E21C 47/00* (2006.01)
*E02F 3/30* (2006.01)
*E21C 27/30* (2006.01)

(58) Field of Classification Search
CPC ..... E02F 3/434; E02F 3/46; E02F 9/2012; G05D 2201/0202; G05B 2219/45012
See application file for complete search history.

(56) References Cited

U.S. PATENT DOCUMENTS 3,786,891 A * 1/1974 Vogelaar ..... A01D 41/12 180/68.4
3,808,783 A * 5/1974 Sutherland ..... A01D 45/021 56/106
3,851,749 A * 12/1974 Vidal ..... E02F 3/48 37/395
3,908,345 A * 9/1975 Oni ..... A01D 41/141 56/208
3,967,437 A * 7/1976 Mott ..... A01D 41/14 56/10.2 R
3,981,125 A * 9/1976 Kerber ..... A01D 41/14 56/14.5
4,099,631 A * 7/1978 Thierer ..... B66D 1/80 198/517
4,373,322 A * 2/1983 Beisel ..... A01D 45/30 56/126
4,565,056 A * 1/1986 Heidjann ..... A01D 41/141 56/14.4
4,910,946 A * 3/1990 Underwood ..... A01D 34/30 56/14.4
4,942,724 A * 7/1990 Diekhans ..... A01D 41/141 56/10.2 E
5,116,186 A * 5/1992 Hanamoto ..... E02F 3/438 37/348
5,178,510 A * 1/1993 Hanamoto ..... E02F 3/437 37/348
5,442,868 A 8/1995 Ahn
5,446,980 A 9/1995 Rocke et al.
5,493,798 A 2/1996 Rocke et al.
5,528,498 A 6/1996 Scholl
5,535,532 A * 7/1996 Fujii ..... E02F 3/435 172/4.5
5,538,084 A * 7/1996 Nakayama ..... E02F 3/844 172/2
5,548,516 A 8/1996 Gudat et al.
5,748,097 A 5/1998 Collins
5,857,828 A * 1/1999 Lee ..... E02F 3/437 37/348
5,908,458 A 6/1999 Rowe et al.
5,953,977 A 9/1999 Krishna et al.
5,978,504 A 11/1999 Leger
6,025,686 A * 2/2000 Wickert ..... E02F 3/435 318/568.18
6,058,344 A 5/2000 Rowe et al.
6,076,030 A 6/2000 Rowe
6,085,583 A 7/2000 Cannon et al.
6,108,949 A 8/2000 Ingh et al.
6,167,336 A 12/2000 Ingh et al.
6,223,110 B1 4/2001 Rowe et al.
6,247,538 B1 6/2001 Takeda et al.
6,317,669 B1 11/2001 Kurenuma et al.
6,336,077 B1 1/2002 Boucher
6,363,173 B1 3/2002 Stentz et al.
6,363,632 B1 4/2002 Stentz et al.
6,732,458 B2 5/2004 Karenuma et al.
7,150,115 B2 12/2006 Parker
7,152,349 B1 * 12/2006 Rowlands ..... E02F 3/46 37/397
7,181,370 B2 2/2007 Furem et al.
7,406,399 B2 7/2008 Furem et al.
7,574,821 B2 8/2009 Furem
7,578,079 B2 8/2009 Furem
7,726,048 B2 6/2010 Stanek et al.
7,751,927 B2 7/2010 Pulli et al.
7,752,779 B2 7/2010 Schoenmaker et al.
7,832,126 B2 11/2010 Koellner et al.
8,078,297 B2 12/2011 Lasher et al.
8,132,345 B2 3/2012 Trifunovic
8,620,533 B2 12/2013 Taylor
8,688,334 B2 4/2014 Taylor
8,838,417 B2 9/2014 Rikkola et al.
9,228,321 B1 * 1/2016 Stratton ..... G08C 17/02
9,372,482 B2 6/2016 Rikkola et al.
2001/0029686 A1 * 10/2001 Leslie ..... E02F 3/48 37/395
2003/0024137 A1 * 2/2003 Briscoe ..... E02F 3/48 37/398
2003/0125856 A1 * 7/2003 Lin ..... B60G 17/005 701/37
2004/0006958 A1 * 1/2004 Thiemann ..... A01D 41/141 56/10.2 R
2006/0070746 A1 * 4/2006 Lumpkins ..... E02F 3/844 172/2
2007/0006492 A1 * 1/2007 Rowlands ..... E02F 3/48 37/348
2007/0150149 A1 * 6/2007 Peterson ..... E02F 3/437 701/50
2008/0201108 A1 8/2008 Furem et al.
2008/0282583 A1 * 11/2008 Koellner ..... E02F 9/264 37/348
2008/0313935 A1 * 12/2008 Trifunovic ..... E02F 3/432 37/413
2009/0277145 A1 * 11/2009 Sauerwein ..... A01D 41/141 56/208
2010/0010714 A1 1/2010 Claxton
2010/0215469 A1 * 8/2010 Trifunovic ..... E02F 3/432 414/699
2010/0222931 A1 * 9/2010 Trifunovic ..... A01B 63/00 700/282
2010/0223008 A1 9/2010 Dunbabin et al.
2010/0226744 A1 * 9/2010 Trifunovic ..... E02F 3/432 414/700
2010/0254793 A1 * 10/2010 Trifunovic ..... E02F 3/432 414/700
2010/0287921 A1 * 11/2010 Trifunovic ..... E02F 3/434 60/327
2011/0301817 A1 * 12/2011 Hobenshield ..... E02F 9/26 701/50
2012/0065847 A1 * 3/2012 Hobenshield ..... G05G 9/04785 701/50
2012/0263566 A1 * 10/2012 Taylor ..... E02F 3/437 414/694
2012/0293316 A1 * 11/2012 Johnson ..... E02F 9/2079 340/438
2014/0025265 A1 * 1/2014 Taylor ..... E02F 3/437 701/50
2014/0064897 A1 * 3/2014 Montgomery ..... E02F 3/434 414/685
2014/0079519 A1 3/2014 Hobenshield
2014/0244118 A1 8/2014 Lee
2015/0039189 A1 * 2/2015 Wu ..... E02F 3/436 701/50
2015/0088358 A1 * 3/2015 Yopp ..... B60W 50/087 701/23
2015/0149017 A1 * 5/2015 Attard ..... B60W 30/18163 701/23
2015/0191890 A1 * 7/2015 Ryan ..... E02F 3/437 414/694
2015/0308074 A1 * 10/2015 Zhdanov ..... E02F 3/844 701/50
2015/0346724 A1 * 12/2015 Jones ..... B60W 30/12 701/23
2016/0040391 A1 * 2/2016 Imaizumi ..... E02F 9/2203 701/50
2016/0270291 A1 * 9/2016 van Vooren ..... A01D 34/40
2016/0334230 A1 * 11/2016 Ross ..... G05D 1/0061
2017/0057542 A1 * 3/2017 Kim ..... B62D 15/025
2017/0248957 A1 * 8/2017 Delp ..... B60W 30/18009

(56) References Cited

U.S. PATENT DOCUMENTS

| | | | | |
|---|---|---|---|---|
| 2017/0267256 | A1* | 9/2017 | Minster | B60W 50/082 |
| 2017/0277182 | A1* | 9/2017 | May | B60W 50/087 |
| 2018/0203451 | A1* | 7/2018 | Cronin | G05D 1/0212 |

FOREIGN PATENT DOCUMENTS

| | | | | |
|---|---|---|---|---|
| EP | 26466 | A2 | * | 4/1981 |
| GB | 1429553 | A | * | 3/1976 |
| GB | 1550595 | A | * | 8/1979 |
| GB | 1551784 | A | * | 8/1979 |
| JP | 2000192514 | | | 11/1997 |
| JP | 11181838 | A | * | 7/1999 |
| JP | 2016089559 | A | * | 5/2016 |
| KR | 1020080058930 | A | * | 6/2008 |
| WO | WO0140824 | | | 6/2001 |
| WO | WO2007057305 | | | 5/2007 |
| WO | WO2008153532 | | | 12/2008 |
| WO | WO2009024405 | | | 2/2009 |

OTHER PUBLICATIONS

Roberts, Jonathan M. et al., "Robot control of a 3500 tonne mining machine", Proceedings of the 1999 IEEE International Workshop on Robot and Human Interaction, Pisa, Italy—Sep. 1999, pp. 213 to 218 (Year: 1999).*

Winstanley, Graeme J. et al., "Dragline swing automation (1999)", Mineral Resources Engineering, vol. 8, No. 3 (1999), pp. 301-312, © Imperial College Press (Year: 1999).*

Dunbabin, Matthew et al., "Autonomous excavation using a rope shovel", Journal of Field Robotics 23 (6/7), 2006, pp. 379-394 (Year: 2006).*

Wikipedia article, "Switch", Old revision dated Aug. 28, 2016, 15 pages (Year: 2016).*

John Deere, L Series Wheel Loader brochure, 844J, DKA844J, Jan. 2006, 16 pages (Year: 2006).*

KIPO translation of KR 1020080058930 (original KR document published Jun. 26, 2008) (Year: 2008).*

Stewart, Larry, "Take charge wheel loader operators fill trucks faster", Construction Equipment, Sep. 28, 2010, 8 pages (Year: 2010).*

Winstanley, Graeme et al., Dragline Automation—A Decade of Development, IEEE Robotics & Automation Magazine, Sep. 2007, p. 52-64.

Examination Report issued from the Chile Patent Office for related Application No. 201702280 dated Dec. 13, 2013 (7 pages including Statement of Relevance).

Hyundai, "Accent", Owners manual, https://hyundai.cl/page/assets/pdf/manual/accent.pdf, 2010 edition, (in Spanish).

Lexus, "ES", Owners manual, https://www.lexusauto.es/forms/manuals/owners-manual, © 2019 Mundo Lexus, (in Spanish).

Chilean Patent Office Action for Application No. 2017-02280 dated Apr. 15, 2019 (7 pages)., (in Spanish).

* cited by examiner

SYSTEM AND METHOD FOR SEMI-AUTONOMOUS CONTROL OF AN INDUSTRIAL MACHINE

RELATED APPLICATIONS

This application claims priority to U.S. Provisional Patent Application No. 62/384,880, filed Sep. 8, 2016, the entire contents of which are hereby incorporated by reference.

FIELD

Embodiments relate to industrial machines.

SUMMARY

Industrial machines, such as electric rope or power shovels, draglines, hydraulic machines, backhoes, etc., are configured to execute operations, for example, crowding, hoisting, swinging, tucking, preparing for a dig, and digging. Typically, such operations are performed by a user controlling one or more movable components of the industrial machine via operator controls, such as but not limited to, one or more joysticks. Some operations, for example but not limited to, an operation including digging and hoisting to remove material from a bank of a mine, may require precise control by the user. Imprecise control may result in inefficient operations.

In order to maximize efficiency, some industrial machines may be capable of autonomous operations. For example, industrial machines may be capable of autonomously performing one or more of the operations discussed above. Various methods of autonomous operations are detailed in U.S. patent application Ser. No. 13/446,817, filed Apr. 13, 2012, U.S. patent application Ser. No. 14/327,324, filed Jul. 9, 2014, and U.S. patent application Ser. No. 14/590,730, filed Jan. 6, 2015, all of which are hereby incorporated by reference. However, such autonomous operations may still require input, or intervention, from the user. For example, input from the user may be necessary when the industrial machine is in a stalling condition, comes into contact with an object, and/or other varying conditions typically found in mining. Such input and intervention are inefficient and may result in a complete restart of an operation.

Therefore, one embodiment provides a method of operating an industrial machine. The method including controlling, via a controller, a movable component of the industrial machine based on a first signal received from an operator control and controlling, via the controller, the movable component of the industrial machine according to an autonomous operation in response to a second signal. The method further including adjusting the autonomous operation to generate an adjusted autonomous operation in response to receiving a third signal from the operator control and controlling, via the controller, the movable component of the industrial machine according to the adjusted autonomous operation in response to receiving a fourth signal.

Another embodiment provides an industrial machine including a movable component, an operator control configured to receive an input from a user, and a controller having an electronic processor and memory. The controller is configured to control a movable component of the industrial machine based on a first signal received from the operator control and control the movable component of the industrial machine according to an autonomous operation in response to a second signal. The controller is further configured to adjust the autonomous operation to generate an adjusted autonomous operation in response to receiving a third signal from the operator control and control the movable component of the industrial machine according to the adjusted autonomous operation in response to receiving a fourth signal.

Other aspects of the invention will become apparent by consideration of the detailed description and accompanying drawings.

DETAILED DESCRIPTION

Figure 1:
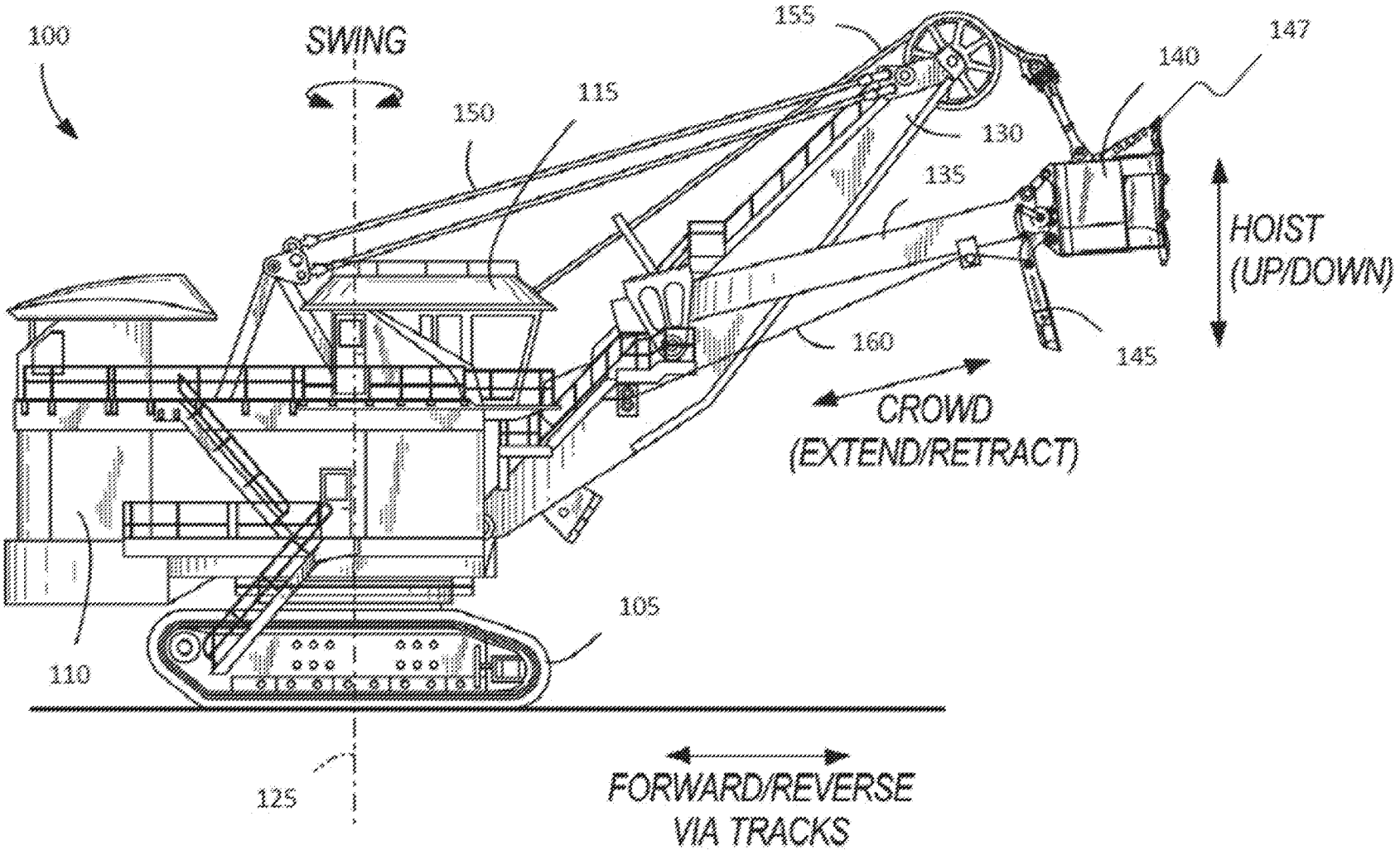
FIG. 1 illustrates an industrial machine according to some embodiments of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using any known means including direct connections, wireless connections, etc.

It should also be noted that a plurality of hardware and software based devices, as well as a plurality of different structural components may be used to implement the invention. In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium) executable by one or more processors. As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible. For example, "controllers" described in the specification can include standard processing components, such as one or more processors, one or more computer-readable medium modules, one or more input/output interfaces, and various connections (e.g., a system bus) connecting the components.

Although the invention described herein can be applied to, performed by, or used in conjunction with a variety of industrial machines (e.g., a mining machine, a rope shovel, a dragline with hoist and drag motions, a hydraulic shovel, a backhoe, etc.), embodiments of the invention described herein are described with respect to an electric rope or power shovel, such as the mining shovel illustrated in FIG. 1. The embodiment shown in FIG. 1 illustrates a mining machine 100, such as an electric mining shovel, as a rope shovel, however in other embodiments the mining machine 100 can be a different type of mining machine, for example, a hybrid mining shovel, a dragline excavator, etc. The mining machine 100 includes tracks 105 for propelling the mining machine 100 forward and backward, and for turning the mining machine 100 (i.e., by varying the speed and/or direction of the left and right tracks relative to each other). The tracks 105 support a base 110 including a cab 115. The base 110 is able to swing or swivel about a swing axis 125, for instance, to move from a digging location to a dumping location. In some embodiments, the swing axis is perpendicular to a horizontal axis. Movement of the tracks 105 is not necessary for the swing motion. The mining machine 100 further includes a boom 130 supporting a pivotable handle 135 (handle 135) and an attachment. In one embodiment, the attachment is a bucket 140. The bucket 140 includes a door 145 for dumping contents from within the bucket 140 into a dump location, such as a hopper, dump-truck, or haulage vehicle. The bucket 140 further includes bucket teeth 147 for digging into a bank of the digging location. It is to be understood that various industrial machines may have various attachments (e.g., a backhoe having a scoop, an excavator having a bucket, a loader having a bucket, etc.). Although various embodiments described within discuss the use of the bucket 140 of the mining machine 100, any attachment of an industrial machine may be used in conjunction with the invention as described.

The mining machine 100 also includes taut suspension cables 150 coupled between the base 110 and boom 130 for supporting the boom 130; one or more hoist cables 155 attached to a winch (not shown) within the base 110 for winding the cable 155 to raise and lower the bucket 140; and a bucket door cable 160 attached to another winch (not shown) for opening the door 145 of the bucket 140.

The bucket 140 is operable to move based on three control actions: hoist, crowd, and swing. The hoist control raises and lowers the bucket 140 by winding and unwinding hoist cable 155. The crowd control extends and retracts the position of the handle 135 and bucket 140. In one embodiment, the handle 135 and bucket 140 are crowded by using a rack and pinion system. In another embodiment, the handle 135 and bucket 140 are crowded using a hydraulic drive system. The swing control rotates the base 110 relative to the tracks 105 about the swing axis 125. In some embodiments, the bucket 140 is rotatable or tiltable with respect to the handle 135 to various bucket angles. In other embodiments, the bucket 140 includes an angle that is fixed with respect to, for example, the handle 135.

Figure 2:
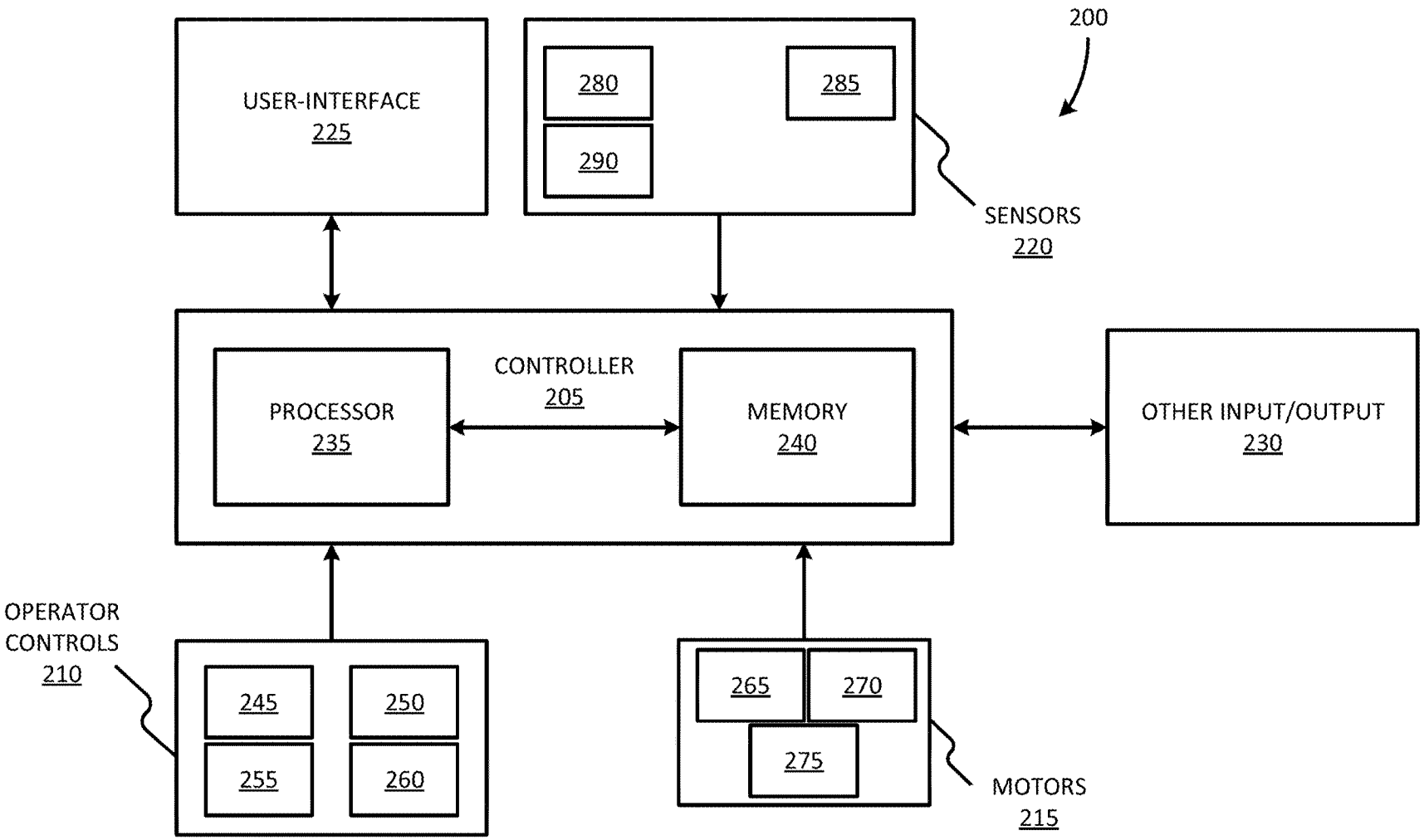
FIG. 2 illustrates a block diagram of a control system of the industrial machine of FIG. 1 according to some embodiments of the invention.

FIG. 2 illustrates a control system 200 of the mining machine 100. It is to be understood that the control system 200 can be used in a variety of industrial machines besides the mining machine 100 (e.g., a dragline, hydraulic machines, constructions machines, backhoes, etc.) The control system 200 includes a controller 205, operator controls 210, motors 215, sensors 220, a user-interface 225, and other input/outputs (I/O) 230. The controller 205 includes a processor 235 and memory 240. The memory 240 stores instructions executable by the processor 235 and various inputs/outputs for, e.g., allowing communication between the controller 205 and the operator or between the controller 205 and sensors 220. In some instances, the controller 205 includes one or more of a microprocessor, digital signal processor (DSP), field programmable gate array (FPGA), application specific integrated circuit (ASIC), or the like.

The controller 205 receives input from one or more operator controls 210. In some embodiments, the operator controls 210 may include a crowd control or drive 245, a swing control or drive 250, a hoist control or drive 255, and a door control 260. The crowd control 245, swing control 250, hoist control 255, and door control 260 include, for instance, operator controlled input devices such as joysticks, track balls, steering wheels, levers, foot pedals, virtual/software driven user-interfaces (e.g., touch displays, voice commands, etc.), and other input devices. The operator controls 210 receive operator input via the input devices and output digital motion commands to the controller 205. The motion commands include, for example, hoist up, hoist down, crowd extend, crowd retract, swing clockwise, swing counterclockwise, bucket door release, left track forward, left track reverse, right track forward, and right track reverse. Although illustrated as including a plurality of operator controls 210, as discussed in further detail below, in some embodiments, the mining machine 100 may include a single operator control 210 or two operator controls 210.

Upon receiving a motion command, the controller 205 generally controls one or more motors 215 as commanded by the operator. The motors 215 include, but are not limited to, one or more crowd motors 265, one or more swing motors 270, and one or more hoist motors 275. For instance, if the operator indicates, via swing control 250, to rotate the base 110 counterclockwise, the controller 205 will generally control the swing motor 270 to rotate the base 110 counterclockwise. However, in some embodiments of the invention the controller 205 is operable to limit the operator motion commands and generate motion commands independent of the operator input.

The motors 215 can be any actuator that applies a force. In some embodiments, the motors 215 can be, but are not limited to, alternating-current motors, alternating-current synchronous motors, alternating-current induction motors, direct-current motors, commutator direct-current motors (e.g., permanent-magnet direct-current motors, wound field direct-current motors, etc.), reluctance motors (e.g., switched reluctance motors), linear hydraulic motors (i.e., hydraulic cylinders, and radial piston hydraulic motors. In some embodiments, the motors 215 can be a variety of different motors. In some embodiments, the motors 215 can be, but are not limited to, torque-controlled, speed-controlled, or follow the characteristics of a fixed torque speed curve. Torque limits for the motors 215 may be determined from the capabilities of the individual motors, along with the required stall force of the mining machine 100.

The controller 205 is also in communication with a number of sensors 220. For example, the controller 205 is in communication with one or more crowd sensors 280, one or more swing sensors 285, and one or more hoist sensors 290. The crowd sensors 280 sense physical characteristics related to the crowding motion of the mining machine and convert the sensed physical characteristics to data or electronic signals to be transmitted to the controller 205. The crowd sensors 280 include for example, a plurality of position sensors, a plurality of speed sensors, a plurality of acceleration sensors, and a plurality of torque sensors. The plurality of position sensors, indicate to the controller 205 the level of extension or retraction of the bucket 140. The plurality of speed sensors, indicate to the controller 205 the speed of the extension or retraction of the bucket 140. The plurality of acceleration sensors, indicate to the controller 205 the acceleration of the extension or retraction of the bucket 140. In some embodiments, the controller 205 calculates a speed and/or an acceleration of a moveable component of the mining machine 100 based on position information received from one or more position sensors. The plurality of torque sensors, indicate to the controller 205 the amount of torque generated by the extension or retraction of the bucket 140. In some embodiments, in addition to, or in lieu of, the torque sensors, torque may be calculated using one or more motor characteristic (for example, a motor current, a motor voltage, etc.).

The swing sensors 285 sense physical characteristics related to the swinging motion of the mining machine and convert the sensed physical characteristics to data or electronic signals to be transmitted to the controller 205. The swing sensors 285 include for example, a plurality of position sensors, a plurality of speed sensors, a plurality of acceleration sensors, and a plurality of torque sensors. The position sensors indicate to the controller 205 the swing angle of the base 110 relative to the tracks 105 about the swing axis 125, while the speed sensors indicate swing speed, the acceleration sensors indicate swing acceleration, and the torque sensors indicate the torque generated by the swing motion.

The hoist sensors 290 sense physical characteristics related to the swinging motion of the mining machine and convert the sensed physical characteristics to data or electronic signals to be transmitted to the controller 205. The hoist sensors 290 include for example, a plurality of position sensors, a plurality of speed sensors, a plurality of acceleration sensors, and a plurality of torque sensors. The position sensors indicate to the controller 205 the height of the bucket 140 based on the hoist cable 155 position, while the speed sensors indicate hoist speed, the acceleration sensors indicate hoist acceleration and the torque sensors indicate the torque generated by the hoist motion. In some embodiments, the torque hoist sensor may be used to determine a bail pull force or a hoist force. In some embodiments, the accelerometer sensors, the swing sensors 285, and the hoist sensors 290, are vibration sensors, which may include a piezoelectric material. In some embodiments, the sensors 220 further include door latch sensors which, among other things, indicate whether the bucket door 145 is open or closed and measure weight of a load contained in the bucket 140. In some embodiments, one or more of the position sensors, the speed sensors, the acceleration sensors, and the torque sensors are incorporated directly into the motors 216, and sense various characteristics of the motor (e.g., a motor voltage, a motor current, a motor power, a motor power factor, etc.) in order to determine acceleration.

The user-interface 225 provides information to the operator about the status of the mining machine 100 and other systems communicating with the mining machine 100. The user-interface 225 includes one or more of the following: a display (e.g. a liquid crystal display (LCD)); one or more light emitting diodes (LEDs) or other illumination devices; a heads-up display (e.g., projected on a window of the cab 115); speakers for audible feedback (e.g., beeps, spoken messages, etc.); tactile feedback devices such as vibration devices that cause vibration of the operator's seat or operator controls 210; or other feedback devices.

The controller 205 may be configured to determine an autonomous operation of the mining machine 100 and control one or more movable components (e.g., the boom 130, the handle 135, the bucket 140, etc.) in accordance with the autonomous operation. In some embodiments, the controller 205 is configured to receive information from one or more operator controls 210, one or more motors 215, and one or more sensors 220. The controller 205 uses the received information to determine an autonomous operation. In some embodiments, the controller 205 determines the autonomous operation using an algorithm, a look-up table, fuzzy logic, artificial intelligence, and/or machine learning.

The controller 205 operates the one or more movable components by controlling the one or more motors 215. In some embodiments, autonomous operations may be, but are not limited to, automated dig, or dig path, operations, automated tuck operations, and/or automated dig preparation operations. Additionally, in some embodiments, autonomous operations may be, but are not limited to, autonomous operations detailed in U.S. patent application Ser. No. 13/446,817, filed Apr. 13, 2012, U.S. patent application Ser. No. 14/327,324, filed Jul. 9, 2014, and U.S. patent application Ser. No. 14/590,730, filed Jan. 6, 2015, all of which are hereby incorporated by reference.

Figure 3:
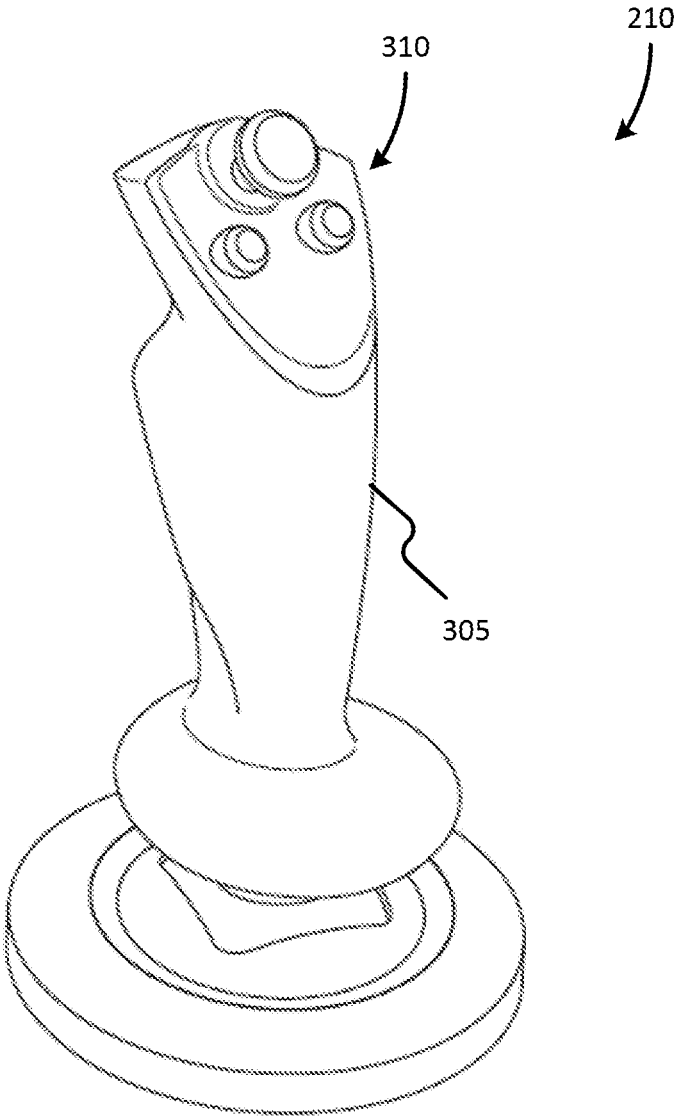
FIG. 3 illustrates a perspective view of an operator control of the industrial machine of FIG. 1 according to some embodiments of the invention.

FIG. 3 illustrates an operator control 210 according to one embodiment of the invention. In the illustrated embodiment, the operator control 210 is a joystick. However, in other embodiments, the operator control 210 may be any other form of a user controlled device, such as but not limited to, track balls, steering wheels, levers, foot pedals, and virtual/software driven user-interfaces (e.g., touch displays, voice commands, etc.). The operator control 210 is configured to receive operator input from a user and output motion commands to the controller 205. The motion controls may then be used, by the controller 205, to direct movement (e.g., a crowd movement, a hoist movement, a swing movement, a tuck movement, a dig movement, a track movement, etc.) of the mining machine 100. In some embodiments, the movement is performed by the one or more motors 215.

Figure 4:
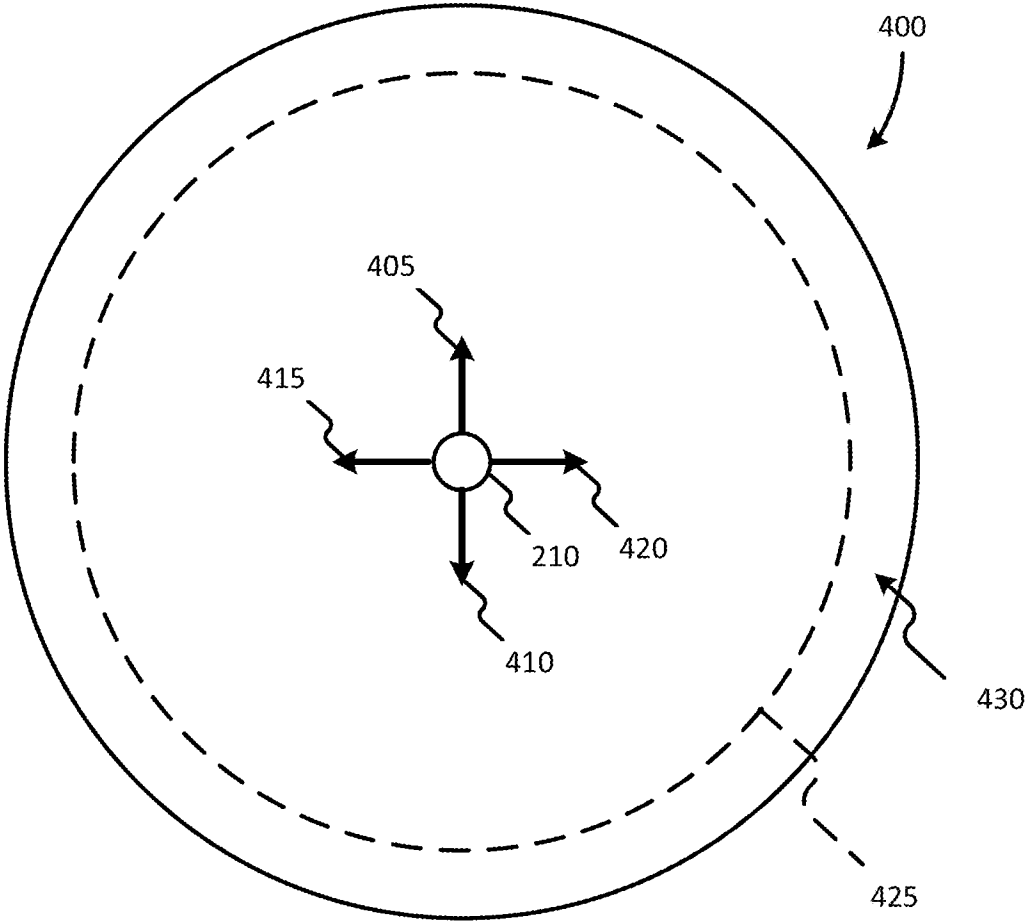
FIG. 4 illustrates a range of motion of the operator control of FIG. 3 according to some embodiments of the invention.

In the illustrated embodiment, the operator control 210 includes a control stick 305 and one or more user-inputs 310. The control stick 305 is configured to be moved within a range of motion 400 (FIG. 4). The one or more user-inputs 310 may include a plurality of buttons, dials, or other devices configured to receive user input. In some embodiments, the mining machine 100 further includes a second user input device. In such an embodiment, the second user input device may be substantially similar to the operator control 210 and used in conjunction with the operator control 210 to control movement of the mining machine 100.

FIG. 4 illustrates a top view of the operator control 210 and a range of motion 400 of the operator control 210 according to some embodiments of the invention. As illustrated, the operator control 210 is configured to be moved in the forward direction (illustrated by arrow 405), the reverse direction (illustrated by arrow 410), the left direction (illustrated by arrow 415), the right direction (illustrated by arrow 420), or any direction there between.

The range of motion 400 may include a reference point, or line, 425 defining a reference area 430. In some embodiments, the reference point 425 is substantially equivalent to 100% of operator control 210 movement within the range of motion 400. In other embodiments, the reference point 425 may be substantially equivalent to another percentage (e.g., approximately 50%, approximately 75%, etc.) of operator control 210 movement within the range of motion 400. Additionally, as illustrated, the reference area 430 may form a complete circumference around the operator control 210.

In operation, during a manual mode, the user moves the operator control 210 within the range of motion 400. As the operator control 210 is moved, motion commands (e.g, one or more first signals) are electronically generated by the operator control 210 and are output to the controller 205. As stated above, the motion commands may then be used, by the controller 205, to direct movement (e.g., a crowd movement, a hoist movement, a swing movement, a dig movement, a track movement, etc.) of the mining machine 100 according to the motion commands.

When a semi-autonomous mode is entered, the controller 205 monitors the motion commands to determine if the operator control 210 has been positioned within the reference area 430. In some embodiments, the semi-autonomous mode is entered by the controller 205 receiving a user input through the user-interface 225 and/or the one or more user-inputs 310 of the operator control 210. In other embodiments, the semi-autonomous mode is entered when the mining machine 100, or one or more components of the mining machine 100, is in a predetermined position.

When the operator control 210 outputs a signal (e.g., one or more second signals) during semi-autonomous mode, the controller 205 controls the one or more movable components (e.g., the boom 130, the handle 135, the bucket 140, etc.) of the mining machine 100 in accordance with an autonomous operation. In some embodiments, the signal is output when the operator control 210 is positioned within the reference area 430. In other embodiments, the signal is output in response to the operator control 210 receiving a user input (for example, when a button, a dial, or other device is activated). In some embodiments, the autonomous operation is predetermined by the controller 205. In other embodiments, the autonomous operation is determined approximately at the moment the operator control 210 is positioned within the reference area 430. In such an embodiment, the autonomous operation may depend on the position of the one or more movable components (e.g., the boom 130, the handle 135, the bucket 140, etc.), characteristics of the one or more motors 215, and characteristics of the one or more sensor 220, at the approximate moment the operator control 210 is positioned within the reference area 430.

At any point during semi-autonomous mode, the user may remove the operator control 210 from within the reference area 430, or stop providing a user input (for example, when a button, a dial, or other device is deactivated), and manually control the mining machine 100. When manually controlling the mining machine 100, the user may be able to intervene and address any situations that the autonomous operation is not able to handle, or has difficulty handling (e.g., a stalling condition and/or contact with an object). Once the situation is addressed, the user may return the operator control 210 to within the reference area 430, or once again provide a user input. Once the operator control 210 is returned to within the reference area 430, or the user input is once again received, the mining machine 100 will resume autonomous operation according to an adjusted autonomous operation.

Figure 5:
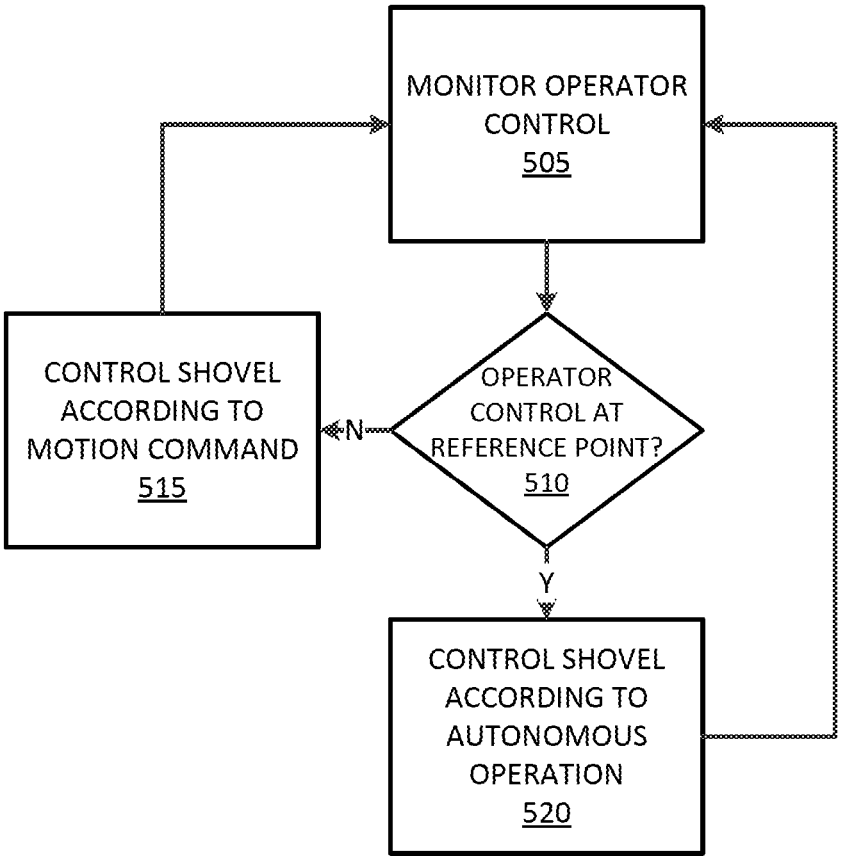
FIG. 5 illustrates an operation of the industrial machine of FIG. 1 according to some embodiments of the invention.

FIG. 5 is a flow chart illustrating a process, or operation, 500 of the mining machine 100 according to one embodiment of the invention. It should be understood that the order of the steps disclosed in process 500 could vary. Furthermore, additional steps may be added to the control sequence and not all of the steps may be required. The controller 205 monitors the operator control 210 (block 505). In some embodiments, the controller 205 monitors the operator control 210 by receiving the one or more motion commands from the operator control 210. The controller 205 determines if the operator control 210 is within the reference area 430, or a user input is received (block 510). When the operator controller 210 is not within the reference area 430, or a user input is not received, the controller 205 controls the mining machine 100 according to the one or more motion commands received from the operator control 210 (block 515). Process 500 then cycles back to block 505. When the operator control 210 is within the reference area 430, or a user input is received, the controller 205 enters autonomous mode and controls the mining machine 100 according to an autonomous operation (block 520). Process 500 then cycles back to block 505. In some embodiments, a second operator control is also monitored. In such an embodiment, process 500 may determine if the operator control 210 is within the reference area 430, or a second user input is received, and if the second operator control is within a second reference area, or a second user input is received, enter the autonomous mode and control the mining machine 100 according to an autonomous operation when such a determination is made.

Figure 6:
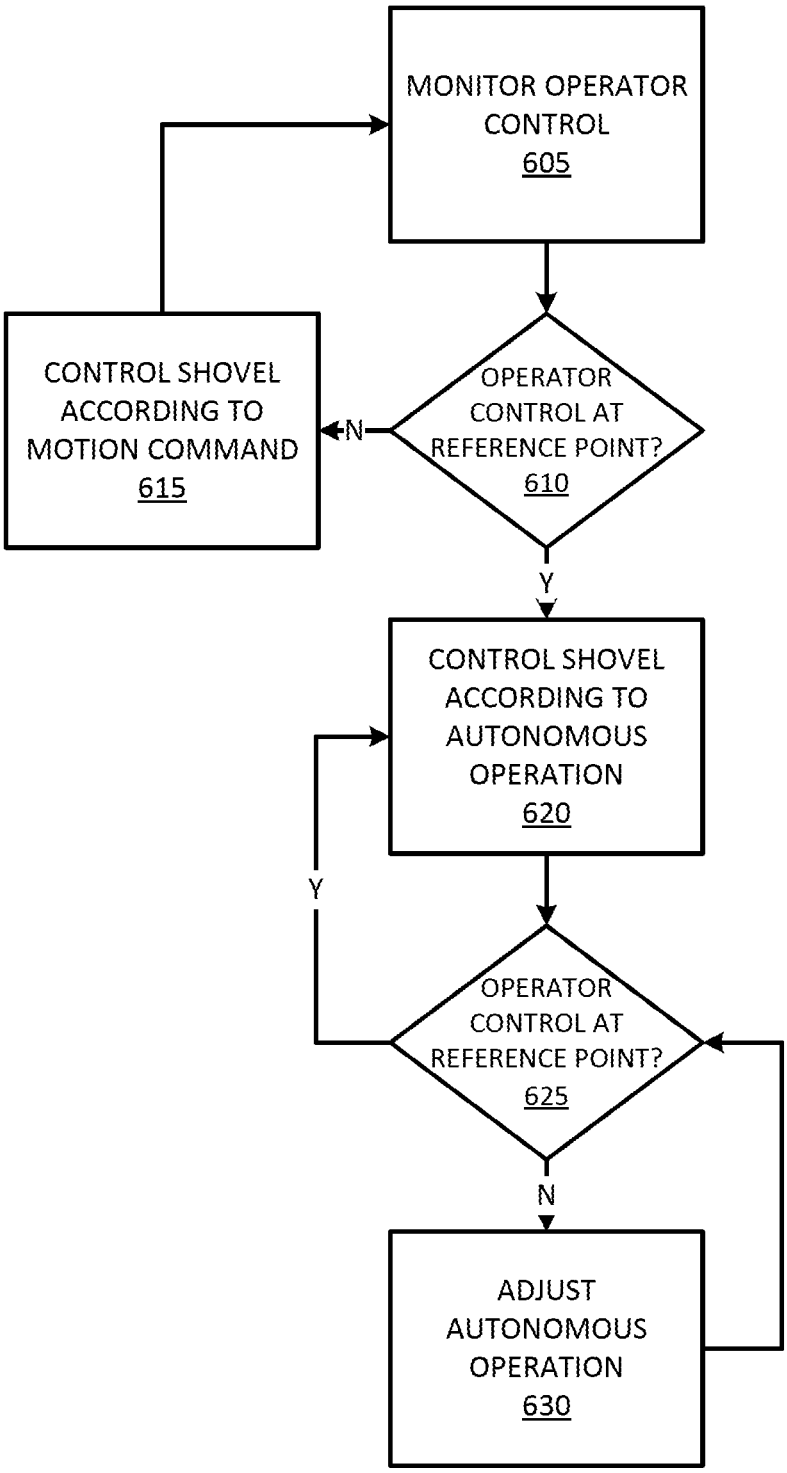
FIG. 6 illustrates an operation of the industrial machine of FIG. 1 according to some embodiments of the invention.

FIG. 6 is a flow chart illustrating a process, or operation, 600 of the mining machine 100 according to one embodiment of the invention. It should be understood that the order of the steps disclosed in process 600 could vary. Furthermore, additional steps may be added to the control sequence and not all of the steps may be required. The controller 205 monitors the operator control 210 (block 605). In some embodiments, the controller 205 monitors the operator control 210 by receiving the one or more motion commands from the operator control 210. The controller 205 determines if the operator control 210 is within the reference area 430, or a user input is received (block 610). When the operator controller 210 is not within the reference area 430, or a user input is not received, the controller 205 controls the mining machine 100 according to the one or more motion commands received from the operator control 210 (block 615). Process 600 then cycles back to block 605.

When the operator control 210 is within the reference area 430, or a user input is received, the controller 205 enters autonomous mode and controls the mining machine 100 according to an autonomous operation (block 620). The controller 205 determines if the operator control 210 is maintained within the reference area 430, or the user input is still received (block 625). When the operator control 210 is maintained within the reference area 430, or the user input is still received, process 600 cycles back to block 620. When the operator control 210 is removed from within the reference area 430, or the user input is not received anymore, the controller 205 adjusts the autonomous operation based on one or more motion commands from the operator control 210 (block 630). Process 600 then cycles back to block 625 to determine if the operator control 210 is returned to within the reference area 430, or if the user input is once again received. When the operator controller 210 is returned to within the reference area 430, or the user input is once again received, the controller 205 controls the mining machine 100 according to an adjusted autonomous operation based on the one or more motion commands received from the operator control 210 in block 630. In some embodiments, a second operator control is also monitored. In such an embodiment, process 600 may determine if the operator control 210 is within the reference area 430 and if the second operator control is within a second reference area, or a second user input is received, and enter the autonomous mode and controls the mining machine 100 according to an autonomous operation when such a determination is made. Additionally, in such an embodiment, process 600 may adjust the autonomous operation based on one or more motion commands from the operator control 210 and the second operator control.

Figure 7B:
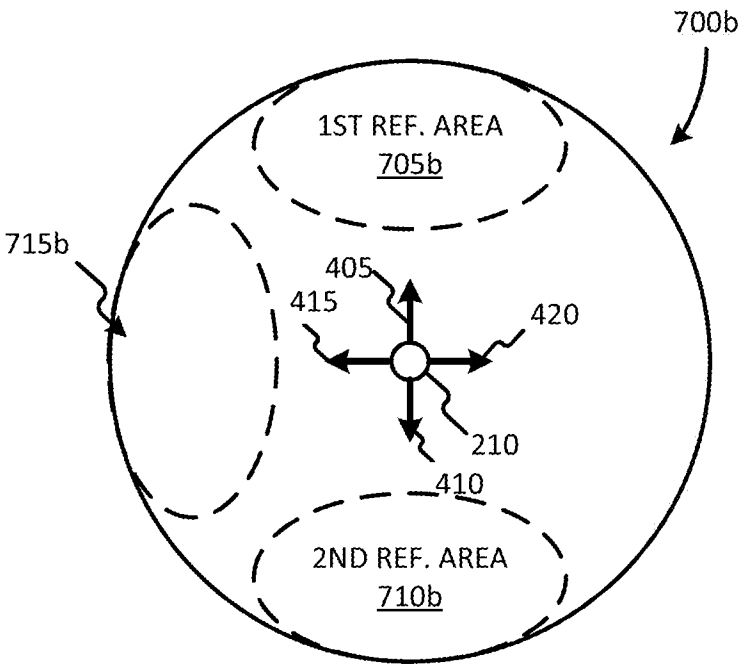
FIGS. 7A and 7B illustrate a range of motion of operator controls of FIG. 3 according to another embodiment of the invention.
Figure 7A:
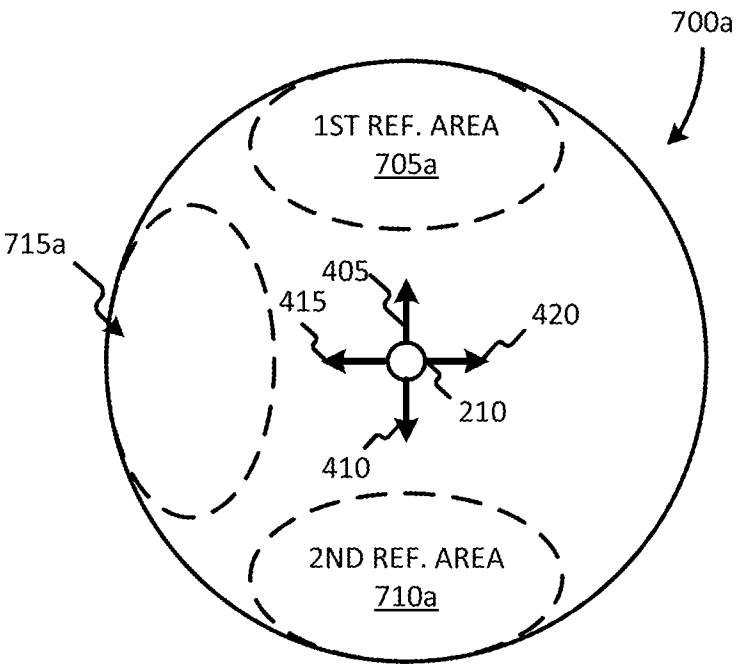

FIGS. 7A and 7B illustrate illustrates a top view of a first operator control 210*a*, a second operator control 210*b*, a first range of motion 700*a* for the first operator control 210*a*, and a second range of motion 700*b* for the second operator control 210*b* according to some embodiments of the invention. As illustrated, the first operator control 210*a* and the second operator control 210*b* are configured to be moved in the forward direction (illustrated by arrow 405), the reverse direction (illustrated by arrow 410), the left direction (illustrated by arrow 415), the right direction (illustrated by arrow 420), or any direction there between. In the illustrated embodiment, the first range of motion 700*a* and second range of motion 700*b* each include a first reference area 705*a*, 705*b*, a second reference area 710*a*, 710*b*, and a third reference area 715*a*, 715*b*. In other embodiments the ranges of motion 700*a*, 700*b* may have more, less, or difference reference area.

In one embodiment of operation, the user moves the operator controls 210*a*, 210*b* within the respective range of motions 700*a*, 700*b*. As the operator controls 210*a*, 210*b* are moved, motion commands are electronically generated by the operator controls 210*a*, 210*b* and are output to controller 205. As discussed above, the motion commands may then be used, by controller 205, to direct movement of the mining machine 100 according to the motion commands.

When a semi-autonomous mode is entered, the controller 205 monitors the motion commands to determine if the operator controls 210*a*, 210*b* have been positioned within one or more of the first reference areas 705*a*, 705*b* and the second reference areas 710*a*, 710*b*. In some embodiments, if one or more operator controls 210*a*, 210*b* have been positioned within the first reference areas 705*a*, 705*b*, the controller 205 controls the one or more movable components of the mining machine 100 in accordance with a first autonomous operation, for example, an autonomous dig operation. In such an embodiment, if one or more operator controls 210*a*, 210*b* have been positioned within the second reference areas 710*a*, 710*b*, the controller 205 controls the one or more movable components of the mining machine 100 in accordance with a second autonomous operation, for example, an autonomous return to tuck operation. Additionally, in such an embodiment, if one or more operator controls 210*a*, 210*b* have been positioned within the third reference areas 715*a*, 715*b*, the controller 205 controls the one or more movable components of the mining machine 100 in accordance with a third autonomous operation, for example, an autonomous swing to hopper operation.

Figure 8:
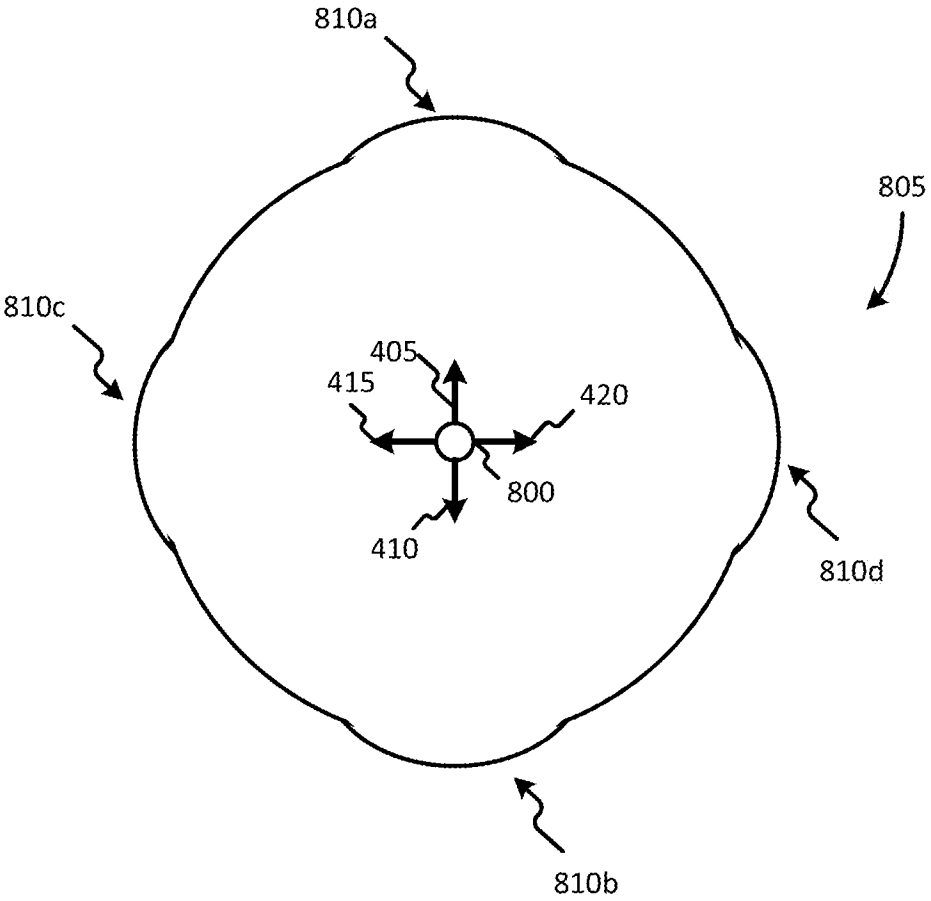
FIG. 8 illustrates a range of motion of the operator control of FIG. 3 according to another embodiment of the invention.

FIG. 8 illustrates a top view of an operator control 800 and a range of motion 805 according to another embodiment of the invention. In the illustrated embodiment, operator control 800 includes one or more detents 810*a*-810*d*. Although illustrated as four detents, the operator control may include more or less detents. In such an embodiment, the detents 810*a*-810*d* may be similar to a reference area.

In operation, when a semi-autonomous mode is entered, the controller 205 monitors the motion commands to determine if the operator control 800 has been positioned within at least one of the detents 810*a*-810*d*. If the operator control 800 has been placed within one of the detents 810*a*-801, the controller 205 controls the one or more movable components of the mining machine 100 in accordance with an autonomous operation, for example, an autonomous dig operation, an autonomous return to tuck operation, or an autonomous swing to hopper operation. In some embodiments, the detents 810*a*-810*d* correspond to different autonomous operations. For example, but not limited to, detent 810*a* may correspond to an autonomous dig operation, while detent 810*b* corresponds to an autonomous return to tuck operation and detent 810*c* corresponds to an autonomous swing to hopper operation.

Thus, the invention provides, among other things, a semi-autonomous operation for a mining shovel. Various features and advantages of the invention are set forth in the following claims.

What is claimed is:

1. A method of operating a rope shovel, the rope shovel including a boom and one or more hoist cables for raising and lowering a bucket, the method comprising:

controlling, via a controller, the bucket of the rope shovel to move based on at least one of a hoist action, a crowd action, and a swing action based on a first signal received from a joystick;

controlling, via the controller, the bucket of the rope shovel according to an autonomous operation in response to a second signal indicative of the joystick entering a reference area, wherein the reference area forms a complete circumference around a joystick neutral point;

detecting, via the controller, a third signal indicative of the joystick being removed from the reference area;

controlling, via the controller, the bucket of the rope shovel based on one or more motion commands from the joystick while the joystick is removed from the reference area; and resuming, via the controller, the autonomous operation in accordance with an adjusted autonomous operation and in response to a fourth signal indicative of the joystick entering the reference area, wherein the adjusted autonomous operation is based on the one or more motion commands from the joystick while the joystick was removed from the reference area.

2. The method of claim 1, wherein the second signal and the fourth signal are generated based on an action by an operator.

3. The method of claim 1, wherein the reference area is defined by a reference point that is substantially equal to 100% of a range of motion of the joystick.

4. The method of claim 1, further comprising controlling, based on a first signal from an operator control different than the joystick, the bucket of the rope shovel.

5. The method of claim 4, further comprising determining, via the controller, if a second signal from the operator control is received; and controlling, via the controller, the bucket of the rope shovel according to the autonomous operation in response to the second signal from the joystick and the second signal from the operator control being received.

6. The method of claim 5, wherein the second signal from the operator control is output in response to the operator control being within a second reference area.

7. The method of claim 6, wherein the second reference area is defined by a reference point that is substantially equal to 100% of a range of motion of the operator control.

8. The method of claim 5, wherein the second signal from the operator control is output in response to the operator control receiving a user input.

9. The method of claim 1, wherein the autonomous operation is at least one selected from the group consisting of an autonomous dig operation, an autonomous dig preparation operation, and an autonomous tuck operation.

10. The method of claim 1, wherein the first signal and the third signal correspond to a manual control by an operator moving the joystick.

11. A rope shovel comprising a boom and one or more hoist cables for raising and lowering a bucket, the bucket operable to move based at least on a hoist action, a crowd action, and a swing action;

a joystick configured to receive an input from a user; and a controller having an electronic processor and memory, the controller configured to control the bucket of the rope shovel based on a first signal received from the joystick;

control the bucket of the rope shovel according to an autonomous operation in response to a second signal indicative of the joystick entering a reference area, wherein the reference area forms a complete circumference around a joystick neutral point;

detect a third signal indicative of the joystick being removed from the reference area;

control the bucket of the rope shovel based on one or more motion commands received from the joystick while the joystick is removed from the reference area; and resume the autonomous operation in accordance with an adjusted autonomous operation and in response to a fourth signal indicative of the joystick entering the reference area, wherein the adjusted autonomous operation is based on the one or more motion commands from the joystick while the joystick was removed from the reference area.

12. The rope shovel of claim 11, wherein the reference area is defined by a reference point that is substantially equal to 100% of a range of motion of the joystick.

13. The rope shovel of claim 11, wherein the second signal and the fourth signal are generated based on an action by the user.

14. The rope shovel of claim 11, further comprising an operator control different than the joystick, wherein the controller is further configured to control, based on a first signal from the operator control, the bucket of the industrial machine.

15. The rope shovel of claim 14, wherein the controller is further configured to determine if a second signal from the operator control is received, and control the bucket of the industrial machine according to the autonomous operation in response to the second signal from the joystick and the second signal from the operator control being received.

16. The rope shovel of claim 15, wherein the operator control outputs the second signal in response to the operator control being within a second reference area.

17. The rope shovel of claim 16, wherein the second reference area is defined by a reference point that is substantially equal to 100% of a range of motion of the operator control.

18. The rope shovel of claim 15, wherein the operator control outputs the second signal in response to the operator control receiving a user input.

19. The rope shovel of claim 11, wherein the autonomous operation is at least one selected from the group consisting of an autonomous dig operation, an autonomous dig preparation operation, and an autonomous tuck operation.

20. The rope shovel of claim 11, wherein the first signal and the third signal correspond to a manual control by the user moving the joystick.

21. An industrial machine comprising:

one or more movable components including at least a boom supporting a pivotable handle and one or more hoist cables for raising and lowering a bucket, the bucket operable to move based at least on a hoist action, a crowd action, and a swing action;

a joystick configured to be moved within a range of motion; and a controller having an electronic processor and memory, the controller configured to:

control the boom based on a first motion command received from the joystick;

in response to determining that the joystick is positioned within a reference area, control the one or more movable components according to an autonomous operation;

in response to determining that the joystick is removed from the reference area, control the boom based on a second motion command received from the joystick; and in response to determining that the joystick has returned to the reference area, resume autonomous operation based on the second motion command received from the joystick, wherein the autonomous operation is an autonomous dig operation, wherein the reference area forms a complete circumference around a joystick neutral point.

22. The industrial machine of claim 21, wherein the reference area is defined by a reference point that is substantially equal to 100% of the range of motion of the joystick.

23. The industrial machine of claim 21, further comprising an operator control different than the joystick, wherein the controller is further configured to control, based on a first signal from the operator control, the one or more movable components of the industrial machine, determine if a second signal from the operator control is received, and control the movable component of the industrial machine according to the autonomous operation in response to the second signal from the joystick and the second signal from the operator control being received.

24. The industrial machine of claim 21, wherein the reference area includes a plurality of reference areas, and wherein each reference area of the plurality of reference areas is associated with a unique autonomous operation.

* * * * *